US005755007A

United States Patent [19]

Dyson

[11] Patent Number: 5,755,007

[45] Date of Patent: May 26, 1998

[54] PORTABLE CLEANING APPARATUS

[75] Inventor: James Dyson, Little Somerford, United Kingdom

[73] Assignee: Notetry Limited, Little Somerford, United Kingdom

[21] Appl. No.: 793,176

[22] PCT Filed: Nov. 24, 1994

[86] PCT No.: PCT/GB94/02575

§ 371 Date: May 7, 1997

§ 102(e) Date: May 7, 1997

[87] PCT Pub. No.: WO96/07350

PCT Pub. Date: Mar. 14, 1996

[30] Foreign Application Priority Data

Sep. 2, 1994 [GB] United Kingdom ..... 9417749

[51] Int. Cl.[6] ..... A47L 5/36

[52] U.S. Cl. ..... 15/327.5; 15/339

[58] Field of Search ..... 15/327.1, 327.5, 15/327.7, 338, 339

[56] References Cited

U.S. PATENT DOCUMENTS

| | | | |
|---|---|---|---|
| 3,820,808 | 6/1974 | Brunning et al. | 15/327.1 X |
| 4,357,177 | 11/1982 | Knox | 15/338 X |
| 5,263,223 | 11/1993 | Fiegel et al. | 15/327.1 X |

FOREIGN PATENT DOCUMENTS

| | | | |
|---|---|---|---|
| 2639817 | 6/1990 | France | 15/327.5 |
| 9302645 | 4/1993 | Germany . | |
| 58283 | 9/1946 | Netherlands | 15/327.3 |
| 658328 | 9/1949 | United Kingdom . | |

*Primary Examiner*—Chris K. Moore
*Attorney, Agent, or Firm*—Ian C. McLeod

[57] ABSTRACT

A portable cleaning apparatus (10) for use with stair treads (20) is described. The apparatus includes a recess (30) which is raised away from the stair tread and is supported on either side of the recess by the body (12) so that the recess is not in contact with the stair tread.

11 Claims, 1 Drawing Sheet

PORTABLE CLEANING APPARATUS

The invention relates to portable cleaning apparatus particularly, but not exclusively, to a cylinder-type vacuum cleaner.

A major problem whilst using vacuum cleaners occurs when vacuuming stairs. Ideally, vacuum cleaners would incorporate a very long hose so that the machine can be left at the bottom of the stairs with the hose reaching all the way to the top of the stairs. This is impractical because such a long hose would be heavy and unwieldy as well as expensive to manufacture and fit. Under normal circumstances, users of vacuum cleaners balance the machine on the stairs at various positions along the flight but this puts the machine in a very unstable position. Upright-type machines, or machines which are convertible between upright use and cylinder use, are slightly more stable when used on stairs than cylinder machines because of the location of their centre of gravity but, in general, vacuum cleaners are positioned very precariously when they are used on stairs. It is common for the user to support the machine with one hand which leaves only one hand free for operation of the hose. Also, because upright-type machines are supported on wheels which contact the stair treads when used in this manner, the vacuum cleaner can roll off the stair tread when the operator's attention is directed elsewhere. This can be dangerous.

It is an object of the present invention to provide portable cleaning apparatus which can be positioned stably on a flight of stairs. It is a further object of the invention to provide portable cleaning apparatus which does not roll off a stair tread when in use on stairs.

The invention provides portable cleaning apparatus as set out in claim 1. Preferable and advantageous features are set out in the subsidiary claims.

The provision of an upwardly extending recess within the lower surface of the body of the portable cleaning apparatus means that, when the apparatus is positioned on the stairs, the corner of a stair tread can project into the recess with the apparatus being supported by two adjacent stair treads. This allows the apparatus to be positioned so that the centre of gravity of the body of the apparatus is adequately spaced from the lowest point of support of the apparatus and lowers the centre of gravity of the body of the apparatus with respect to apparatus not having such a recess. Portable cleaning apparatus according to the invention is thus more stable than prior art apparatus when used on stairs. If the recess is substantially symmetrical in cross section, the position of the apparatus on the stairs can be reversed without any risk of apparatus becoming unstable. The provision of means for preventing relative movement between the apparatus and a stair tread also avoids the problem of the apparatus rolling off the stair tread.

Figure 1:
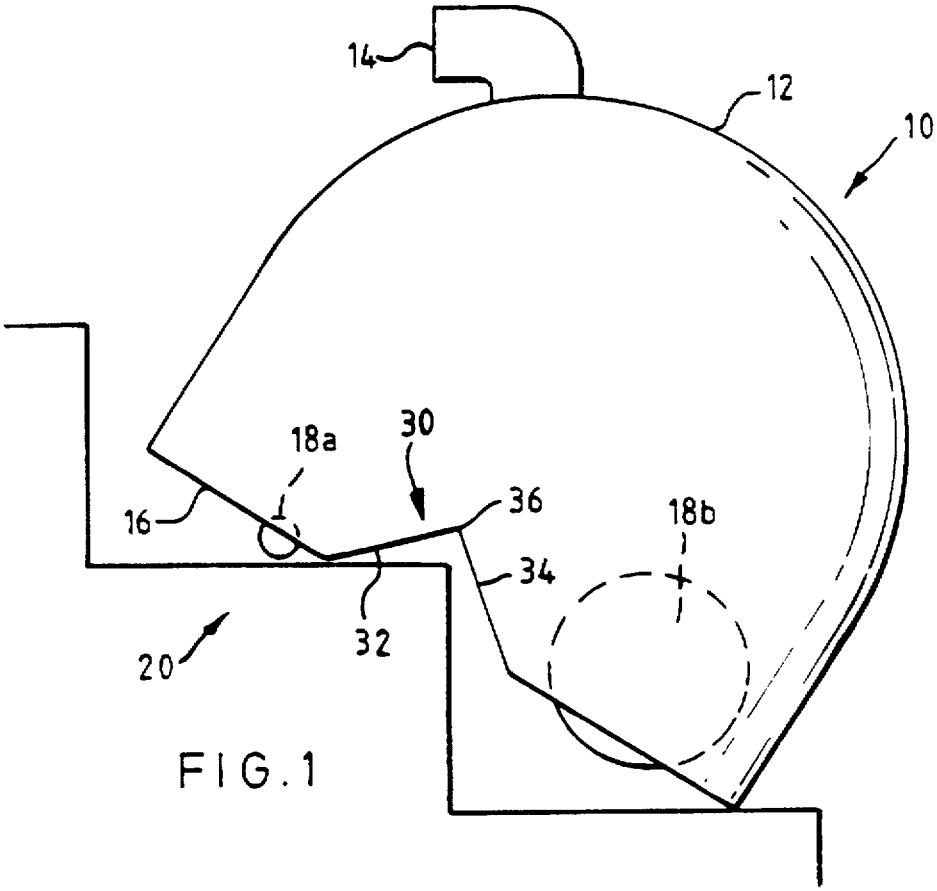
Figure 2:
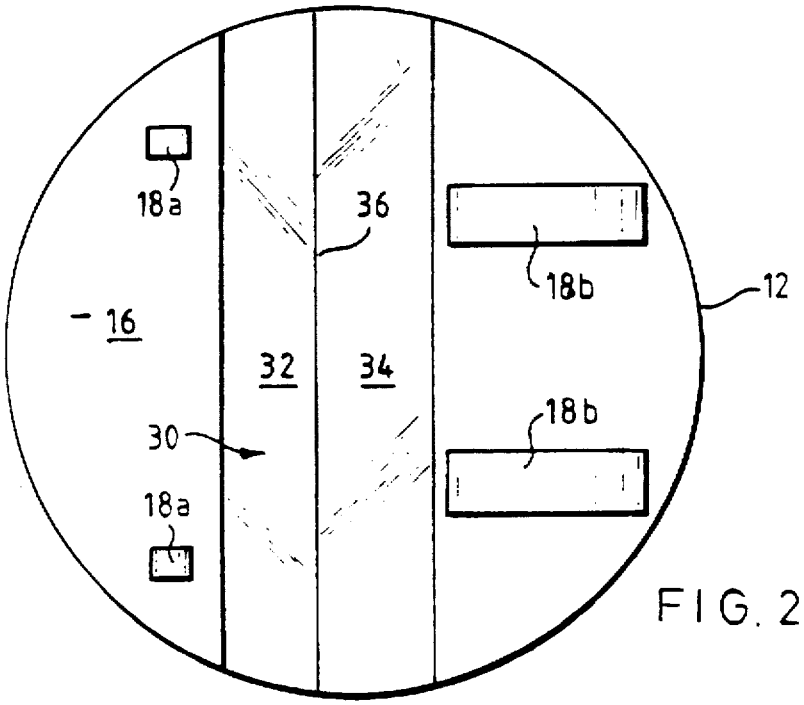

An embodiment of the present invention will now be described with reference to the accompanying drawings wherein:

FIG. 1 is a schematic side view of portable cleaning apparatus according to the present invention; and FIG. 2 is a schematic view of the lower surface of the apparatus shown in FIG. 1.

FIG. 1 shows, in schematic side view, a vacuum cleaner 10 according to the present invention and sitting on a flight of stairs 20. The vacuum cleaner 10 shown in the drawings is a cylinder-type vacuum cleaner; i.e., the only air inlet to dust separating apparatus is via a head or tool connected to the machine by means of a hose. In the embodiment shown, the vacuum cleaner 10 has a body 12 having an inlet 14 connectable to a hose (not shown). The nature of the dust separating apparatus housed within the body 12 is immaterial to the present invention and therefore will not be described in any detail. However, the dust separating apparatus of the cleaner 10 shown in FIG. 1 is preferably cyclonic in nature.

The body 12 of the cleaner 10 has a lower surface 16. Also, wheels 18*a* and 18*b* are positioned on the body 12 so that the rims of the wheels 18*a*, 18*b* project beneath the plane of the lower surface 16. The wheels 18*a*, 18*b* form support means for the vacuum cleaner 10 when it is being used on a flat surface. It will be appreciated that the wheels 18*a*, 18*b* could be replaced by any other form of support means for the vacuum cleaner 10 although these support means are preferably of such a nature as to allow the vacuum cleaner 10 to be easily dragged across a flat surface. The wheels 18*a*, 18*b* could be replaced by rollers, casters, skids or skis and, equally, could be of any desirable size. It is not necessary for the wheels 18*a*, 18*b* to differ in size.

The lower surface 16 is shaped so that it incorporates an upwardly extending recess 30 extending across the entire width of the lower surface 16 (see FIG. 2). The recess 30 is formed by inclined portions 32, 34 of the lower surface 16, the inclined portions 32, 34 meeting at an apex 36. The general shape of the recess 30 shown in FIG. 1 is triangular with the inclined portion 32 meeting the inclined portion 34 substantially at a right angle. The inclined portions 32, 34 need not be of equal length although a substantial difference in length of these inclined portions 32, 34 would be detrimental. Furthermore, the angle at the apex 36 need not be a right angle although substantial deviations from 90° would be undesirable. However, the recess 30 is ideally shaped so as to be substantially symmetrical about an axis generally perpendicular to the lower surface 16. This enables the position of the cleaner 10 to be reversed with respect to the stairs 20 if required.

The lower portion 16 is shaped so that, when the vacuum cleaner 10 is tilted to an appropriate angle and placed on consecutive stair treads, portions of the lower surface 16 or body 12 come into direct contact with the upper surfaces of the respective stair treads. The wheels 18*a*, 18*b* are thus maintained out of contact with the stairs 20. As shown in FIG. 1, the points of contact of the lower surface 16 with the stair treads 20 when the vacuum cleaner 10 is placed on the stairs are preferably angular portions. This assists the vacuum cleaner 10 in gripping the upper surfaces of the stair treads 20 and minimises the risk of the vacuum cleaner 10 slipping from the desired position. Although not shown in the figures, grip-enhancing means can be provided on the appropriate areas of the lower surface 16; for example, pads of rubber or plastics material having non-slip surfaces can be provided at the points of contact.

It is also possible to dimension the body 12 and lower surface 16 such that the inclined portions 32, 34 abut directly against the horizontal and vertical walls of the stair 20. With such an arrangement, slip-resistant materials could be used to coat or cover either or both of the inclined portions 32, 34.

It is naturally essential that the centre of gravity of the vacuum cleaner 10 be arranged so that, when the vacuum cleaner 10 is positioned in an inclined manner as shown in FIG. 1, the centre of gravity acts along a line located to the left of the point of contact of the cleaner 10 with the lower stair. Otherwise, the cleaner will be unstable and will tend to topple.

Preferably, the body 12 of the vacuum cleaner 10 is provided with a handle (not shown) to assist the user in positioning the vacuum cleaner 10 onto appropriate stairs 20. Ideally, the handle will be arranged so that it is convenient for use when the vacuum cleaner 10 is being used on stairs and on a flat surface.

Although the above embodiment relates to a vacuum cleaner, the portable cleaning apparatus in accordance with the invention may be shampoo apparatus (e.g. operating with wet detergent or dry powder), wet pick-up apparatus, a steam cleaner, or any similar portable apparatus for use on stairs.

I claim:

1. A portable cleaning apparatus comprising a body having a lower surface, first and second portions of the lower surface as a part of the body, and an upwardly extending recess for accommodating a stair tread wherein the apparatus rests on a first stair tread on the first portion of the lower surface of the body adjacent the recess and rests on a second stair tread on the second portion of the lower surface of the body at an end of the apparatus opposite the first portion of the body with the recess between the first and second portions of the body, wherein the recess is out of contact with the stair treads.

2. The apparatus as claimed in claim 1, wherein the first and second portions comprise angular edges on the lower surface.

3. The apparatus as claimed in any one of claims 1 or 2, wherein the recess is substantially symmetrical about an axis generally perpendicular to the lower surface in side view between the first and second portions of the lower surface of the body.

4. The apparatus as claimed in any one of claims 1 or 2, wherein the recess is substantially a triangle in side view between the first and second portions of the lower surface of the body.

5. The apparatus as claimed in any one of claims 1 or 2, wherein the recess is substantially a triangle in side view between the first and second portions of the lower surface of the body and wherein an apex of the triangle is positioned substantially centrally of the recess and comprises a right angle in the side view between the first and second portions of the lower surface of the body.

6. The apparatus as claimed in any one of claims 1 or 2, wherein the first and second portions of the lower surface have wheels which are disengaged from the stair tread when the first and second portions of the lower surface of the body are mounted on the stair treads.

7. The apparatus as claimed in any one of claims 1 or 2, wherein the apparatus is a cyclonic vacuum cleaner.

8. The apparatus as claimed in any one of claims 1 or 2 wherein the recess is substantially symmetrical in cross-section about an axis generally perpendicular to the lower surface in side view between the first and second portions of the lower surface to provide a triangle and wherein the first and second portions of the lower surface of the body are provided with wheels which are disengaged from the stair treads when the first and second portions of the lower surface of the body are mounted on the stair treads.

9. The apparatus as claimed in any one of claims 1 or 2 wherein an apex of a triangle is positioned substantially centrally of the recess and comprises a right angle in side view between the first and second portions of the lower surface of the body and wherein the first and second portions of the lower surface of the body are provided with wheels which are disengaged from the stair treads when the first and second portions of the lower surface of the body are mounted on the stair treads.

10. The apparatus as claimed in any one of claims 1 or 2 wherein the recess is substantially symmetrical in cross-section about an axis generally perpendicular in side view between the first and second lower surfaces to provide a triangle and wherein the first and second portions of the lower surface of the body are provided with wheels which are disengaged from the stair treads when the first and second portions of the lower surface of the body are mounted on the stair treads and wherein the apparatus is a cyclonic vacuum cleaner.

11. The apparatus as claimed in any one of claims 1 or 2 wherein an apex of a triangle is positioned substantially centrally of the recess and comprises a right angle in side view between the first and second portions of the lower surface of the body, wherein the first and second lower surfaces of the body are provided with wheels which are disengaged from the stair treads when the first and second portions of the lower surface of the body are mounted on the stair treads and wherein the apparatus is a cyclonic vacuum cleaner.

* * * * *